US006966715B2

(12) United States Patent
Narita et al.

(10) Patent No.: US 6,966,715 B2
(45) Date of Patent: Nov. 22, 2005

(54) FILM TRANSFER TOOL AND METHOD FOR PRODUCING A SMALL DIAMETER ROLLER FOR USE FOR A TRANSFER HEAD OF A FILM TRANSFER TOOL

(75) Inventors: Yasuo Narita, Iruma (JP); Katsuaki Takahashi, Iruma (JP)

(73) Assignee: Plus Stationery Corporation, Tokyo (JP)

( * ) Notice: Subject to any disclaimer, the term of this patent is extended or adjusted under 35 U.S.C. 154(b) by 72 days.

(21) Appl. No.: 10/615,245

(22) Filed: Jul. 9, 2003

(65) Prior Publication Data

US 2004/0050502 A1 Mar. 18, 2004

Related U.S. Application Data

(62) Division of application No. 09/893,397, filed on Jun. 29, 2001, now Pat. No. 6,805,762.

(30) Foreign Application Priority Data

Jun. 30, 2000 (JP) ..... 2000-198721
Apr. 19, 2001 (JP) ..... 2001-121301

(51) Int. Cl.[7] ..... B44C 7/00

(52) U.S. Cl. ..... 400/248; 400/207; 156/577; 118/257

(58) Field of Search ..... 156/577; 400/248, 400/242, 207, 208; 118/257

(56) References Cited

U.S. PATENT DOCUMENTS 3,839,127 A * 10/1974 Hazuka et al. ..... 156/540
4,358,333 A * 11/1982 Holland-Letz ..... 156/384
5,632,203 A * 5/1997 Voeltner et al. ..... 101/348
5,685,944 A * 11/1997 Nose et al. ..... 156/540
5,845,574 A * 12/1998 Dilling et al. ..... 101/351.6
6,270,578 B1 * 8/2001 Murakoshi ..... 118/257
6,629,552 B1 * 10/2003 Herrmannsen et al. ..... 156/577

* cited by examiner

*Primary Examiner*—Andrew H. Hirshfeld
*Assistant Examiner*—Dave A. Ghatt
(74) *Attorney, Agent, or Firm*—Swindler Berlin LLP

(57) ABSTRACT

The present invention relates to a film transfer tool that allows a transfer head to be disposed in any of the spaces between letters of normally used word processors for implementation of a smooth transfer operation of film. The film transfer tool includes a feed reel and a take-up reel, which are adapted to interlock with each other. The reels are disposed within a case, and a film transfer tape is fed out from the feed reel to be moved along a surface while being pressed thereagainst by a transfer head protruding from the case. The transfer tape is then taken up by the take-up reel. The film transfer tool also includes a support frame and a transfer roller to rotatably extend between facing side pieces of the support frame and having an outside diameter ranging from 1 mm to 3 mm.

6 Claims, 6 Drawing Sheets

FILM TRANSFER TOOL AND METHOD FOR PRODUCING A SMALL DIAMETER ROLLER FOR USE FOR A TRANSFER HEAD OF A FILM TRANSFER TOOL

CROSS-REFERENCE TO RELATED APPLICATIONS

This patent is a division of U.S. patent application Ser. No. 09/893,397 filed on Jun. 29, 2001, now U.S. Pat. No. 6,805,762, which is incorporated herein by reference in its entirety.

BACKGROUND OF THE INVENTION

The present invention relates to a film transfer tool for use in transferring a stratified film provided on a film transfer tape to the surface of a paper for correcting a letter or letters.

As is disclosed in, for example, Japanese Examined Patent Publication No. 47-40543, a film transfer tool is known in which a feed reel and a take-up reel which are adapted to interlock with each other via a power transmission means are disposed within a case, whereby a film transfer tape is fed out from the feed reel so as to be moved over the surface of a paper while being pressed against the surface of the paper with a transfer head protruding from the case, and the film transfer tape is then taken up by the take-up reel as a tape from which a film has been transferred.

In the conventional example, the transfer head is constituted by the transfer roller, whereby a film transfer tape is pressed against the surface of a paper so as to transfer a film to the surface of the paper while the transfer roller is being rotated, and since the transfer roller having a large outside diameter is used, there is a limitation to the scope of application of the film transfer tool of this type. Namely, spaces between letters of normally used word processors are substantially 0.5 mm, and such a conventional transfer roller cannot be disposed in any of those narrow spaces between the letters of the word processor to transfer a film onto a letter contiguous to any of the spaces. To cope with this, a transfer head comprising a small piece having a triangular cross section has been used as a transfer head that can be disposed in the narrow spaces between the letters, but that type of transfer head does not roll as a roller does, and therefore a pressing force (transfer load) which is greater than required is destined to be exerted on the transfer tape. Thus, with this transfer head it is rot always ensured that a smooth transfer operation can be carried out.

The present invention relates to a method for producing a small diameter roller for use for a transfer head of a film transfer tool.

Conventionally, there have been filed many applications for patent on film transfer tools for correcting typographical errors. For example, Japanese Utility Model Unexamined Publication No. 6-73026 discloses a film transfer tool in which a spatula-like transfer head is provided at a distal end of a main body of the tool for handling a film transfer tape so as to transfer a transfer film onto the surface of a paper.

A film transfer tool of this type is generally referred to as a spatula-like head type film transfer tool, and since they are easy to be produced, film transfer tools of the type have been used widely. In this type of film transfer tools, however, there has been a case where the surface of a paper is scratched on an end of the head in transferring a film, and moreover there has been often a case where in trying to transfer a film so as to overlap the film that has just been transferred the lower film is scraped with the spatula-like transfer head. Widths of currently marketed film transfer tapes range from 3 mm to 6 mm and film transfer tapes are classified into a plurality of types for smaller to larger letters, respectively. So, if film transfer tapes of those types are used appropriately depending on widths of letters to be corrected, letters can be corrected at one time without transferring film on film in an overlapping fashion. However, from the consumers' point of view, it is economical buying a film transfer tape of an intermediate width to transfer film on film in an overlapping fashion depending on the width of letters to be corrected rather than buying several film transfer tapes of different widths. Due to this, there have been many consumers who make a practice of doing this, and therefore it is important to solve the problem that film cannot be transferred on film in the overlapping fashion.

In addition, the spatula-type head has the following problems:

as a fatal problem attributed to the construction thereof, the film transfer tape is easy to slide transversely while being fed;

the film cannot be not properly transferred if the main body of the film transfer tool is inclined while being in use and;

if it is not strong, the film cannot be transferred.

Adopting a roller type transfer head is one of solutions to the aforesaid problems. With the transfer head being a roller, even if the end of the transfer head is brought into contact with the surface (of a paper) to which film is being transferred, the transfer head only rolls on the surface without scratching the same, and therefore there is no risk of the lower film that has been transferred before being stripped off by the transfer head. This type of transfer head is known as a roller type transfer head, and not only the roller type transfer head is effective in solving the problem with the film-on-film overlapping transfer of film, but also it makes difficult for the film transfer tape to deviate transversely during a film transfer operation to thereby provide the user of the transfer tool with a better handling feel. This makes it easy to transfer film directly on a letter or letters to be corrected. In addition, the property that the film transfer tape is difficult to deviate transversely is effective in solving the problem that the film transfer tape is dislocated from the transfer head during a film transfer operation.

Thus, the roller type transfer head provides superior features, but it has been difficult to produce a small diameter roller for use in the film transfer tool. Due to this, products have been widely marketed which find no problem with being provided with a roller of a relatively large diameter such as a transfer tool for a gluing tape, but roller type film transfer tools which need to be provided with a roller of a small diameter have not yet been widely marketed as a product.

Conventional production methods of small diameter rollers and problems inherent therein will be described below.

(1) Two-Color Injection Molding Method

According to this production method, a shaft which has been injection molded is injection molded again for provision of a resilient film.

In this method, the shaft is made from resin, the shaft needs to have a certain thickness so as to provide a sufficient strength in use. In addition, even in the molding process, since an injection pressure of a certain magnitude is exerted on the shaft while the shaft is being subjected to a second injection, the shaft needs to be strong, and therefore, it has been difficult to produce a small diameter shaft.

(2) Compression Molding

Compression molding requires two molding operations to be carried out, which leads to problems of high costs and an expensive mold. In addition, this method can provide only a low processing accuracy, and therefore the method has not been suitable for production of small diameter shafts.

(3) Resilient Tube Fitting Method

According to this production method, a tube made of a resilient material is forcibly fitted on a metallic or resin shaft. This method can provide only weak adherence and has suffered a problem that the resilient tube deviates transversely from the shaft when the transfer head is strongly pressed against the surface of a paper during a film transfer operation.

SUMMARY OF THE INVENTION

An object of the present invention is to provide a film transfer tool suitable for a smooth transfer operation of transfer film for putting a transfer tape to a space between letters.

The present invention is, as means for solving above object, provides a film transfer tool in which a feed reel and a take-up reel which are adapted to interlock with each other via a power transmission means are disposed within a case, whereby a film transfer tape is fed out from the feed reel so as to be moved over the surface of a paper while being pressed against the surface of the paper with a transfer head protruding from the case, and the film transfer tape is then taken up by the take-up reel as a tape from which a film has been transferred, the film transfer tool being characterized in that the transfer head is constituted by a supporting frame provided on the case in such a manner as to protrude therefrom and a transfer roller provided in such a manner as to rotatably extend between side pieces of the supporting frame, the transfer roller having an outside diameter of 1 mm to 3 mm, and that a resilient member is provided oil the transfer roller of the transfer head so as to constitute an outer circumferential layer of the transfer roller, so that the film transfer tape is brought into press contact with an axial intermediate portion of the resilient member.

Note that with a diameter smaller than 1 mm the tap transfer load (tape drawing load) is increased, and the roller becomes unable to roll. Thus, the roller which is unable to roll functions substantially the same as the small piece did as described above. On the other hand, with a diameter greater than 3 mm, since an angle formed between the gazing line and the surface of the paper for confirming the transfer position ranges from 40 to 90 degrees, when the confirmation angle is 40 degrees, a distance between a contact point (a pressing point) between the transfer roller and the surface of a paper via the transfer tape and a point (a visible point) where a straight line (a gazing line) connecting the eyes with the contact point of the roller and the surface of the paper intersect with each other becomes larger than 0.5 mm which is equal to the spaces between the letters of the normal word processors, thereby making it difficult to confirm the correction starting point.

Also, the present invention is to provide a method for producing a small diameter roller for use for a transfer head of a film transfer tool which can obtain a high production accuracy.

With a view to attaining the object, according to a first aspect of the present invention, there is provided a method for producing a small roller for use for a transfer head of a film transfer tool in which a heat shrinkable tube is placed over a core material and then is heated so as to shrink to cover the core material.

According to the first aspect of the present invention, since the heat shrinkable tube is placed over the core material and thereafter is heated so that the heat shrinkable tube shrinks and covers the core material, there is no need to forcibly fit the resilient tube on the core material, facilitating the producing operation.

In addition, according to the first aspect of the present invention, the adherence between the heat shrinkable tube and the core material can be improved by applying a primer treatment or adhesive to the core material in advance.

Furthermore, according to the same aspect of the present invention, the miniaturization of the roller can be attained by placing the heat shrinkable tube which is formed thin over the thin core material so that the core material is eventually covered by the heat shrinkable tube.

Moreover, according to the aspect of the present invention, the production process can be facilitated by cutting to a suitable dimension the core material which is formed long after the core material is eventually covered by the heat shrinkable tube.

According to a second aspect of the present invention, there is provided a method as set forth in the first aspect of the invention wherein a collar portion is provided at each end of the core material for preventing the axial deviation of the heat shrinkable tube.

According to the second aspect of the present invention, the heat shrinkable tube can be prevented from deviating transversely in production and use by providing the collar portions at the ends of the core material for preventing the transverse deviation of the heat shrinkable tube.

According to a third aspect of the present invention, there is provided a method for producing a small diameter roller for use for a transfer head of a film transfer tool in which the small diameter roller is produced by submerging a rubber or silicone rubber tube in petroleum oil or an organic solvent to let the tube swell, the rubber or silicone rubber tube being formed to have an inside diameter which is smaller than the outside diameter of a core material, placing the rubber or silicone rubber tube that has so swollen over the core material and thereafter drying the rubber or silicone rubber tube so placed over so that the tube shrinks to cover the core material.

According to the third aspect of the present invention, even if the tube is formed so as to have the inside diameter which is smaller than the outside diameter of the core material, submerging the tube in petroleum oil or an organic solvent can cause the tube to swell enough to easily be placed over the core material. This is really true in the event that the inside diameter of the tube becomes larger than the outside diameter of the core material as a result of submerging the tube in petroleum oil or an organic solvent. Moreover, even if the inside diameter of the tube still remains smaller than the outside diameter of the core material, there will be no difficulty in placing the tube over the core material because the petroleum oil or organic solvent functions as lubricating oil.

In addition, according to the third aspect of the present invention, the adherence between the tube and the core material can be improved by applying a primer treatment or adhesive to the core material in advance.

Furthermore, according to the same aspect of the present invention, the production process can be facilitated by cutting to a suitable dimension the core material which is formed long after the core material has been covered by the rubber or silicone rubber tub.

Moreover, according to this aspect of the present invention, the miniaturization of the roller can be attained by placing the rubber tube which is formed thin over the thin core material so that the core material is eventually covered by the rubber tube.

According to a fourth aspect of the present invention, there is provided a method as set forth in the third aspect of the invention, wherein a collar portion is provided at each end of the core material for preventing the axial deviation of the heat shrinkable tube.

According to the fourth aspect of the present invention, the transverse deviation of the rubber or silicone tube relative to the core material can be prevented while in production or in use by providing the collar portions at the ends of the core material.

According to a fifth aspect of the present invention, there is provided a method for producing a small diameter roller for use for a transfer head of a film transfer tool in which the small diameter core material is produced by forming a resilient coat over a core material through painting or coating.

According to the fifth aspect of the present invention, the small diameter core material can be formed by forming the thin resilient coat over the core material.

In addition, according to this aspect of the present invention, the production process can be facilitated by cutting the core material which is formed long to a suitable dimension after the core material has been covered by the thin resilient film.

Furthermore, according to the same aspect of the present invention, the number of production processes can be reduced further than the case where the heat shrinkable tube is used or the case where the tube is used which is swollen by petroleum oil or an organic solvent, and the production cost can also be reduced by automating the painting and coating processes.

According to a sixth method for producing a small diameter roller for use for a transfer head of a film transfer tool in which the small diameter roll is produced by forming a rubber-like material over an outer circumferential surface of a core material through insert molding.

According to the sixth aspect of the present invention, the construction of the mold can be made simple when compared to the two-color injection molding, and therefore the mold cost can be reduced.

In addition, according to the sixth aspect of the present invention, since a metallic shaft can be used for the core material, the core material can be made thin.

Furthermore, according to this aspect of the present invention, the thin resilient film can be formed with higher accuracy than the compression molding. Moreover, according to the same aspect of the invention, the production cost can be reduced by automating the molding process.

According to a seventh aspect of the present invention, there is provided a method for producing a small diameter roller for use for a transfer head of a film transfer tool in which the small diameter roller is produced by loosely placing over a small diameter shaft which is cut to a suitable length a hollow shaft formed to have an inside diameter which is larger than the outside diameter of the small shaft.

According to the seventh aspect of the present invention, since no resilient film is coated on the shaft, the external configuration of the roller can be produced small.

In addition, according to the seventh aspect of the present invention, since no resilient film is provided on the shaft, there can be produced the small diameter roller for the transfer head which has an advantage that the adhesion of the transfer film to the surface of a paper can be facilitated through the construction of the film transfer tool in which when using the film transfer tool, the pressing force of the transfer head generated when the transfer head is pressed against the surface of the paper concentrates on a single point.

Furthermore, according to the same aspect of the present invention, high strength can be secured by using hard resin or metal for the core material.

According to an eighth aspect of the present invention, there is provided a method for producing a small diameter roller for use for a transfer head of a film transfer tool in which the small diameter roller is produced by forming simultaneously a core material and a resilient portion through two-color extrusion molding and thereafter cutting the core material and the resilient portion to a suitable dimension.

According to the eighth aspect of the present invention, the small diameter roller can easily be produced by forming the core material and resilient portion continuously long and then cutting the core material and resilient portion so formed to a required length. Thus, this aspect of the invention is effective in reducing the production cost.

In addition, according to the same aspect of the present invention, high strength can be secured by using a metal shaft for the core material.

According to a ninth aspect of the present invention, there is provided a method for producing a small diameter roller for use for a transfer head of a film transfer tool in which the small diameter roller is produced by skiving a resin or metallic material.

According to the ninth aspect of the present invention, since no resilient film is coated on the shaft, the external configuration of the roller can be produced small.

In addition, according to the ninth aspect of the present invention, since there is provided no resilient film, the small diameter roller for the transfer head can be produced which can facilitate the adhesion of the transfer film to the surface of a paper through the construction of the film transfer tool in which when using the film transfer tool, the pressing force of the transfer head generated when the transfer head is pressed against the surface of the paper concentrates on a single point.

Furthermore, according to the same aspect of the present invention, high strength can be secured by using hard resin or metal for the shaft.

DETAILED DESCRIPTION OF THE PREFERRED EMBODIMENTS

Figure 1:
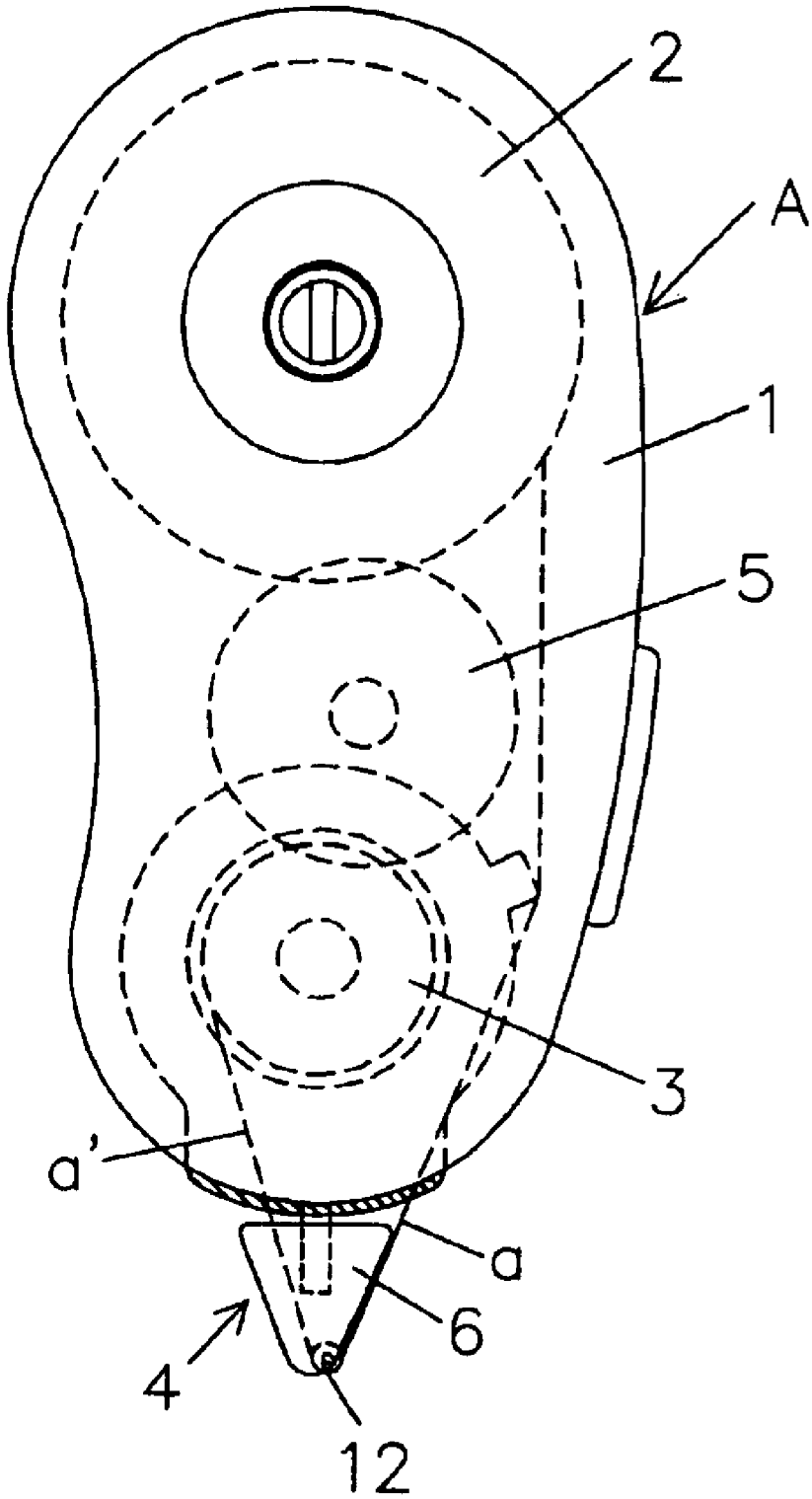
FIG. 1 is a front view showing a preferred embodiment of the film transfer tool for the present invention.
Figure 2:
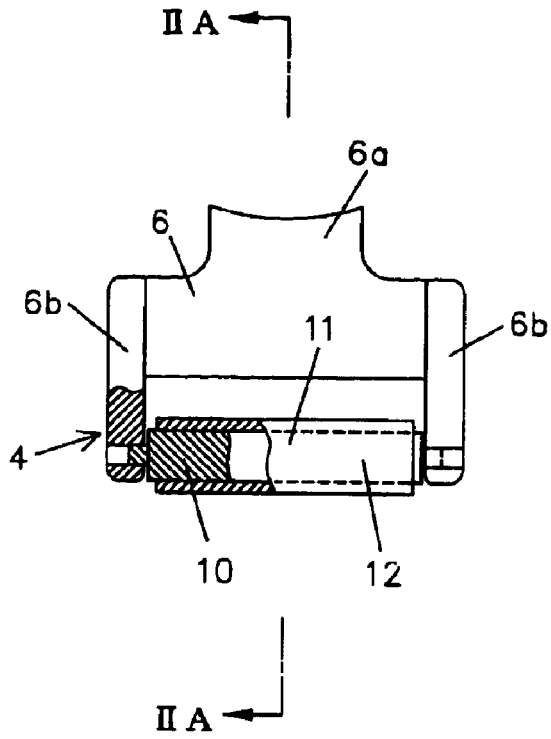
FIG. 2 is a partially cut-away front view of a film transfer head as viewed from a side of the film transfer head shown in FIG. 1.
Figure 3:
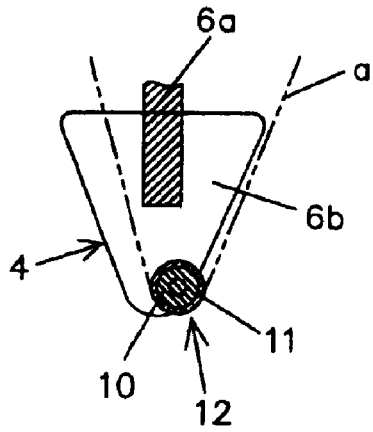
FIG. 3 is a cross-sectional view taken along the line IIA—IIA.
Figure 4:
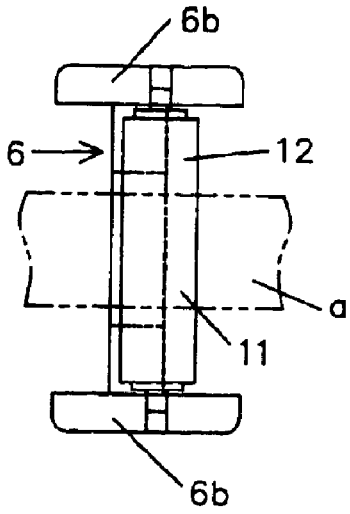
FIG. 4 is a bottom view of FIG. 2.
Figure 5:
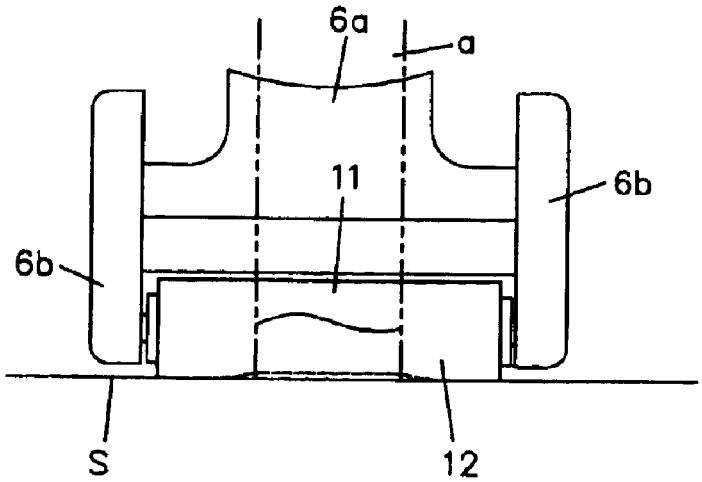
FIG. 5 is an enlarged view of FIG. 2.

FIGS. 1–5 show one embodiment of a film transfer tool according to the present invention, wherein FIG. 1 is a front view of a film transfer tool, FIG. 2 is a partially cut-away front view of a film transfer head portion as viewed from a side of the film transfer tool shown in FIG. 1, FIG. 3 is a cross-sectional view taken along the line IIA—IIA in FIG. 2, FIG. 4 is a bottom view of FIG. 2, and FIG. 5 is an enlarged view of FIG. 2.

In a film transfer tool A according to an embodiment of the present invention, a feed reel 2 and a take-up reel 3 are disposed within a case 1, and a leading end of a film transfer tape a fed from the feed reel is attached to the take-up reel 3 via a transfer head 4 attached to the case 1 at a proximal portion thereof in such a manner as to protrude therefrom. In addition, an intermediate gear 5 is interposed as a power transmission means between a driving gear disposed concentrically with the feed reel 2 within the case 1 and a follower gear disposed concentrically with the take-up gear 3 also within the case 1. With the transfer tool A according to the embodiment, when a film is moved along the surface of a paper while a film transfer tape a is being pressed by the transfer head, the tape a is fed out from the feed reel 2 and a film on the tape a is transferred to the surface of the paper. At the same time as this operation occurs the driving gear rotates and rotates the follower gear via the intermediate gear 5, whereby the take-up reel 3, which is concentric with the follower gear, rotates so as to take up the tape a as a tape a from which the film has been transferred. The difference in the number of rotations between the feed reel 2 and the take-up reel 3 is automatically compensated for so that a transfer operation can be carried out.

In the transfer head 4, a transfer roller 7 is provided so as to rotatably extend between distal end portions of side pieces 6*b*, 6*b* of a support frame 6 which are disposed on sides of a central piece 6*a* so as to face each other, and a proximal portion of the central piece 6*a* of the support frame 6 is disposed within the case 1 so as to be attached to the case 1, so that the transfer head 4 is provided in such a manner as to protrude from the case 1.

The transfer roller 12 is constructed as a cylindrical body having an outside diameter of 2 mm by securely fitting a metallic core material 10 in a cylindrical resilient member 11, the core material 10 having a circular cross section and being made thinner at ends thereof, and the axial length of the resilient member which constitutes an outer circumferential layer of the transfer roller 12 is made longer than the lateral width of the tape a. The transfer roller 12 is provided so as to extend between the side pieces 6*b*, 6*b* as described above such that the tape a is disposed at an axially intermediate portion of the resilient member in such a manner as to be pressed thereagainst, and the thinner or smaller diameter end portions of the core material 10 are brought into engagement with through holes 8 formed in the side pieces 6*b* by making use of resilient deformation of the side pieces 6*b* so that the core material 10 is assembled to the side pieces 6*b* or the support frame 6, the transfer head 4 being thus constructed.

The core material 10 may be formed of synthetic resin and the resilient member 11 is made of a material such as rubber and resin. Alternatively, a stratified resilient film of rubber or resin may be provided over the core material 10.

The press contact of the film transfer tape against the outer circumferential layer of the transfer roller 12 at the axially intermediate portion is implemented by making use of tension generated by providing the film transfer tape a in such a manner as to extend between the feed reel 2 and the take-up reel 3, and as a result of this, as shown in FIG. 5, the tape a fits in the resilient member 11 at a portion where the tape a contacts the resilient member 11 by virtue of the resilient deformation of the resilient member 11, whereby side portions of the resilient member 11 which are contiguous to the tape a portion are brought into contact with the surface of a paper S, and if the tape a is moved while being in contact with the surface of the paper S, a contact resistance is generated between the side portions of the resilient member 11 of the transfer roller 12 and the surface of the paper S, whereby the transfer roller 12 rolls smoothly, the efficiency of the transfer operation being thereby improved.

In addition, the transfer roller 12 is adapted to protrude from side edges of the side pieces 6*b* of the support frame 6 on a frontal side thereof as viewed in a traveling direction of the transfer tool during a transfer operation so that the transfer tool A (the case 1) can be used in an inclined fashion at a certain angle, and the press contact condition of the transfer roller 12 with the surface of the paper S via the tape a can be visualized through this inclination angle for a smooth transfer operation.

Note that the center piece 6*a* constituting the support frame 6 is resiliently deformable and the resilient deformation of the center piece 6*a* serves to prevent the application of excessive transfer load (press contact load of the roller 12) to the surface of the paper, whereby any damage to the surface of the paper S is prevented in turn.

Note that the outside diameter of the transfer roller 12 may range from 1 mm to 3 mm.

Thus, in the construction as has been described heretofore, when the transfer roller 12 is moved by holding the case 1 while the transfer roller 12 is kept in contact with the surface of the paper S, since the transfer roller 12 is made wider than the tape a, i.e., since the tape a exists at the axially intermediate portion of the transfer roller 12, end portions of the roller 12 which are contiguous to the tape a, respectively, are brought into contact with the surface of the paper and then start to rotate as the aforesaid traveling operation is carried out, whereby the tape a is fed out and taken up and the film is transferred to the surface of the paper, a transfer operation being thereby implemented.

While a film transfer tool A according to the embodiment comprises a feed reel 2, a take-up reel 3, a film transfer tape a and the like which are disposed and incorporated in a case 1, the present invention is not limited to the film transfer tool so constructed but a cartridge may be used. Namely, the cartridge comprises a set of a feed reel 2 around which the film transfer tape a is wound and a take-up reel 3 for taking up therearound the film transfer tape a that has been used, and is removably loaded in the case 1.

In addition, the film transfer tool A according to the present invention may adopt a construction in which a feed reel and a take-up reel are constructed integrally, the feed reel 2 and the take-up reel 3 are disposed in an axially contiguous positional relationship and a clutch mechanism is provided in a gap between the feed reel 2 and the take-up reel 3 for generating an appropriate magnitude of friction when the reels rotate. With the film transfer tool A constructed as described above, the space occupied by the reels can be reduced dramatically when compared to a system in which the feed reel interlocks with the take-up reel via gears, whereby a main body of the film transfer tool can be formed small.

Since the present invention is constructed as has been described heretofore, the transfer head of the film transfer tool of the present invention may be disposed in any of the spaces between letters of the normally used word processors without any inconveniences to implement a smooth transfer of the film.

In addition, despite the fact that the transfer roller is made thin in diameter, since the end portions of the transfer roller contacts with the surface of the paper and rolls while being resiliently deformed, the transfer roller can roll or the transfer operation of the film can be implemented without any inconveniences.

The method for producing a small diameter roller for use for a transfer head of a film transfer tool according to the present invention will be described.

Figure 6:
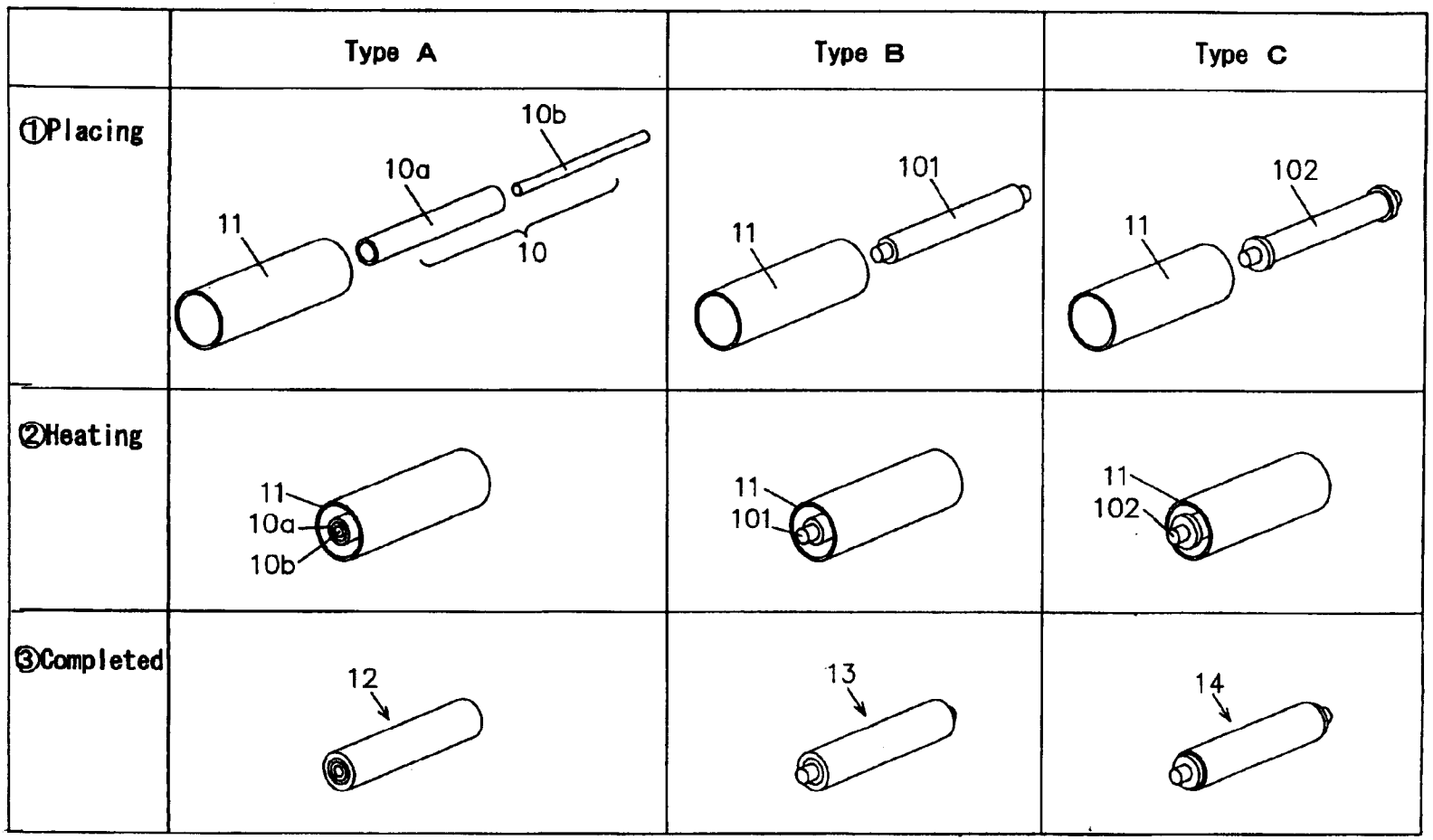
FIG. 6 is a diagram explaining a production process according to a first embodiment of a method for producing a small diameter roller of the present invention.

FIG. 6 shows a first embodiment according to the present invention, which is a diagram explaining processes in which a heat shrinkable tube is placed over a core material.

The figure shows three different production processes; Type A, Type B, Type C, depending on configurations of core materials used. A heat shrinkable tube 11 uses a tube made of silicone rubber which is cut in advance to a length corresponding to the length of a core material that the tube is to cover. Core materials 10, 101, 102 denote core materials of different types, respectively. The core material 10 denotes a core material constructed by loosely fitting a shaft 10*b* in a hollow shaft 10*a*, and the core material 101 denotes a core material whose ends are formed thinner by skiving. In addition, a core material 102 denotes a core material which is formed by skiving, similarly to the core material 101, and a collar portion is provided at each end of the core material for preventing the axial deviation of the heat shrinkable tube placed over the core material.

Firstly, the production process of Type A will be described.

The hollow shaft 10*a* and the shaft 10*b* and the heat shrinkable tube 11 are fitted in one another to produce a state shown by (2) in the figure. Note that the hollow shaft 10*a* and the shaft 10*b* and the heat shrinkable tube 11 are cut to a suitable dimension in advance. Next, hot air is sent to them in this state to heat them. Then, the heat shrinkable tube shrinks to adhere to the shaft 10*b*, whereby the core material 10 is covered by the heat shrinkable tube to thereby constitute a small diameter roller 12.

As with Type B and Type c, a roller 13 and a roller 14 are produced similarly by placing heat shrinkable tubes over the core materials 101, 102, respectively.

Thus, the first embodiment according to the present invention is a method for producing a roller in which the roller is produced by placing a heat shrinkable tube over a core material and thereafter heating the tube so that the heat shrinkable tube shrinks to cover the core material.

According to the present invention, since the heat shrinkable tube is heated to shrink after the same tube has been placed over the core material, the elastic tube does not have to forcibly be fitted on the core material but can be fitted on the core material lightly at the time of production, whereby the production process can be facilitated.

In addition, the miniaturization of the roller can be attained by using the heat shrinkable tube which is formed thin and the core material having the small outside diameter.

Furthermore, at the time of production the heat shrinkable tube is placed over the core material which is formed long, and the core material and tube can be cut to a required dimension, whereby the production process can be facilitated more than individually placing heat shrinkable tubes over short core materials.

Next, a second embodiment according to the present invention will be described. As a matter of convenience, the description of features of the second embodiment which are similar to those described with reference to the first embodiment will be omitted and only features thereof which are different from those of the first embodiment will be described.

The second embodiment according to the present invention provides a method for producing a roller in which the roller is produced by submerging a resilient tube in petroleum oil or an organic solvent to let the tube swell, which resilient tube is formed so as to have an inside diameter which is smaller than the outside diameter of a core material, placing the tube that has so swollen over the core material, and thereafter letting the tube so placed over the core material dry so that the core material is covered by the tube.

In this embodiment, a silicone rubber tube is used as the resilient tube.

Figure 7:
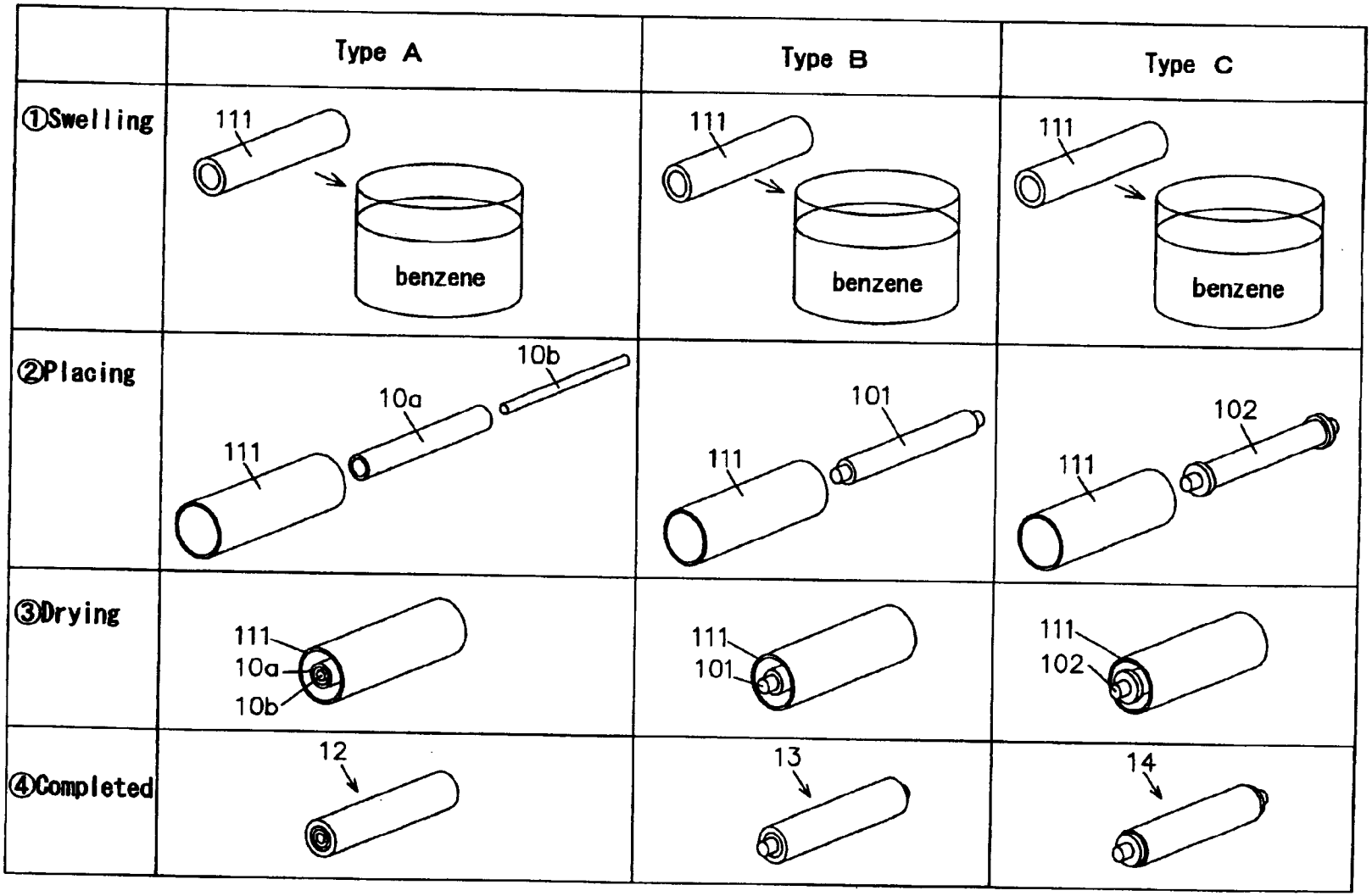
FIG. 7 is a diagram explaining a production process according to a second embodiment of a method for producing a small diameter roller of the present invention.

FIG. 7 is a diagram explaining production processes according to the second embodiment. The resilient tube (the silicone rubber tube) 111 is let to swell by submerging the silicone rubber tube in benzene. Similarly to the first embodiment, the silicone rubber tube 111 that has been let to so swell is then placed over a core material, and thereafter the silicone tube and the core material are put in an drying machine so as to let them dry, whereby a small diameter roll 12, 13, 14 is produced in each type of production process.

According to the present invention, even with the tube which is formed so as to have the inside diameter which is smaller than the outside diameter of the core material, the tube can easily be placed over the core material by submerging the tube in petroleum oil or an organic solvent. In addition, as this occurs, the adherence of the tube to the core material can be improved by applying a primer treatment to the core material in advance. Additionally, an adhesive may be applied to the core material in advance instead of the application of the primer treatment to the core material.

Note that while the second embodiment has been described using the method in which the silicone rubber tube is let to swell by submerging the tube in benzene, since it is known that silicone rubber exhibits the swelling properties in the order of 10 to 15% relative to alcohol or acetone and in the order of about 100 to 200% relative to non-polar organic compounds such as petroleum oil, benzene, and toluene, the silicone rubber tube may be submerged in solvent of any of the other organic compounds than benzene to let it swell. Since silicone rubber only swells and does not go into solution or deteriorate relative to the organic compounds, the tube shrinks to adhere to the core material by letting the tube dry after the tube has been placed over the core material.

In addition, as with the first embodiment, the production process can be facilitated by cutting to a required dimension the core material which is formed long after the core material has been covered by the resilient tube.

Next, a third embodiment according to the present invention will be described. As a matter of convenience, the description of features of the third embodiment which are similar to those described with reference to the first embodiment will be omitted and only features thereof will be described which are different from the features of the first embodiment.

The third embodiment according to the present invention provides a method for producing a roller by painting or coating a core material with a rubber material so as to cover the core material with a resilient film. The construction of the core material is similar to those described with reference to the first and second embodiments, and painting or coating is applied to the core material by any of normally known means.

According to the present invention, the thin resilient film can be coated on the core material. In addition, similarly to the first embodiment, the production process can be facilitated by cutting to a required dimension the core material which is formed long after the core material is covered by the resilient film.

Furthermore, according to the present invention, the number of production processes can be reduced further than the case where the heat shrinkable tube is used or the case where the tube is used which is swollen by petroleum oil or an organic solvent, and the production cost can also be reduced by automating the painting and coating processes.

Next, a fourth embodiment according to the present invention will be described.

The fourth embodiment according to the present invention provides a method for producing a roller in which the roller is produced by insert molding a rubber-like material on an outer circumference of a core material. The construction of the core material used in this embodiment is similar to those of the core materials described with reference to the first and second embodiments.

According to the present invention, the construction of a mold used can be simplified when compared to that used in the two-color molding, whereby the mold cost can be made inexpensive.

In addition, since a metallic shaft can be used for the core material, the core material can be made thinner.

Furthermore, according to the present invention, the thin resilient film can be formed with higher accuracy than through compression molding. Additionally, the production cost can be reduced by automating the molding process.

Next, a fifth embodiment according to the present invention will be described.

The fifth embodiment according to the present invention provides a method for producing a roller in which the roller is produced by loosely fitting a hollow shaft on a metallic shaft, which hollow shaft is formed so as to have an inside diameter which is larger than the outside diameter of the metallic shaft. The construction of the core material is similar to those of the core materials described with reference to Type A in the first and second embodiments. The core material 10 is constructed by loosely fitting the shaft 10*b* to a shaft 10*a*.

According to the present invention, since the shaft is coated with no resilient film, the external configuration of the roller can be produced small. In addition, since no resilient film is provided on the shaft, when using a film transfer tool, an advantage can be obtained that the adhesion of a transfer film to the surface of a paper can be facilitated by the concentration of pressing force generated when the transfer head is pressed against the surface of the paper.

Next, a sixth embodiment according to the present invention will be described.

The sixth embodiment of the present invention provides a method for producing roller in which the roller is produced by simultaneously forming a core material and a resilient portion through two-color extrusion molding.

Figure 8:
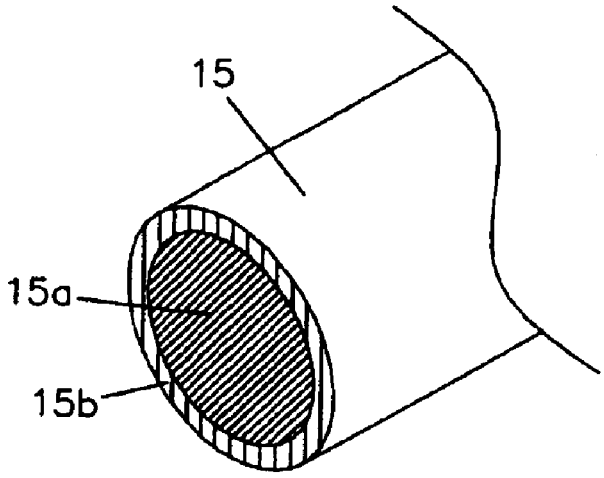
FIG. 8 is a diagram showing a cross-sectional construction of a roller produced in accordance with a sixth embodiment of a method for producing a small diameter roller of the present invention.

FIG. 8 shows a cross-sectional construction of a roller 15 produced in accordance with the sixth embodiment. According to this embodiment, as is clear from the figure, a core material 15*a* and a resilient portion 15*b* can simultaneously be produced.

The two-color molding is a molding process referred to as a double mode molding or a multi-color molding in which two colors or two kinds of resins are used to mold an integrated product, and a molding process is carried out with exclusive equipment provided with two sets of injection apparatus.

Figure 9:
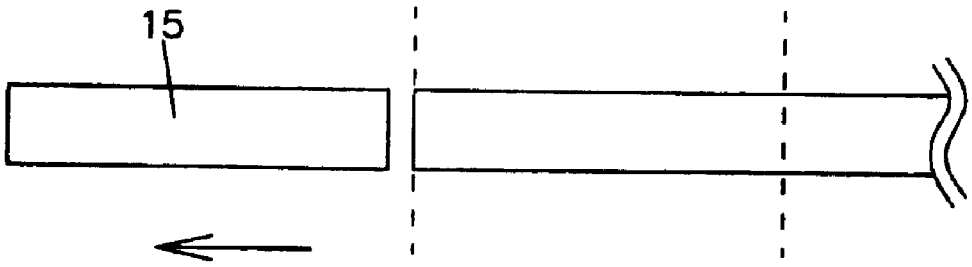
FIG. 9 is a diagram showing a diagram explaining a cutting process for a roller produced in accordance with an embodiment as shown in FIG. 8.

As shown in FIG. 9, according to the present invention, the roller can easily be produced by cutting the core material to a required dimension after the core material has been continuously formed long, and the process of this embodiment is effective in reducing the production cost. This feature is identical to that of the first embodiment.

In addition, a metallic shaft can be used for the center shaft to thereby secure higher strength.

Next, a seventh embodiment according to the present invention will be described.

The seventh embodiment of the present invention provides a method for producing a roller by skiving a resin or metallic material.

According to the present invention, since no resilient film is coated on the shaft, the external configuration of the roller can be produced small.

In addition, according to the present invention, there can be produced the small diameter roller for the transfer head which has an advantage that the adhesion of the transfer film to the surface of a paper can be facilitated through the construction of the film transfer tool in which when using the film transfer tool, the pressing force of the transfer head generated when the transfer head is pressed against the surface of the paper concentrates on a single point.

Furthermore, according to the same aspect of the present invention, high strength can be secured by using hard resin or metal for the shaft.

The present invention is practiced in the aspects that have been described heretofore and provides the following advantages.

According to the present invention, since the heat shrinkable tube is placed over the core material and thereafter is heated so that the heat shrinkable tube shrinks and covers the core material, there is no need to forcibly fit the resilient tube on the core material but the tube can lightly be fitted on the core material, facilitating the producing operation.

In addition, according to the present invention, the adherence between the heat shrinkable tube and the core material can be improved by applying a primer treatment or adhesive to the core material in advance.

Furthermore, according to the present invention, the miniaturization of the roller can be attained by placing the heat shrinkable tube which is formed thin over the thin core material so that the core material is eventually covered by the heat shrinkable tube.

Moreover, according to the present invention, the production process can be facilitated by cutting to a suitable dimension the core material which is formed long after the core material is eventually covered by the heat shrinkable tube.

According to the present invention, the heat shrinkable tube can be prevented from deviating transversely in production and use by providing the collar portions at the ends of the core material for preventing the transverse deviation of the heat shrinkable tube.

According to the present invention, even if the tube is formed so as to have the inside diameter which is smaller than the outside diameter of the core material, submerging the tube in petroleum oil or an organic solvent can cause the tube to swell enough to easily be placed over the core material. This is really true in the event that the inside diameter of the tube becomes larger than the outside diameter of the core material as a result of submerging the tube in petroleum oil or an organic solvent. Moreover, even if the inside diameter of the tube still remains smaller than the outside diameter of the core material, there will be no difficulty in placing the tube over the core material because the petroleum oil or organic solvent functions as lubricating oil.

In addition, according to the present invention, the adherence between the tube and the core material can be improved by applying a primer treatment or adhesive to the core material in advance.

Furthermore, according to the present invention, the production process can be facilitated by cutting to a suitable dimension the core material which is formed long after the core material has been covered by the rubber or silicone rubber tub.

Moreover, according to the present invention, the miniaturization of the roller can be attained by placing the rubber tube which is formed thin over the thin core material so that the core material is eventually covered by the rubber tube.

According to the present invention, the transverse deviation of the rubber or silicone tube relative to the core material can be prevented while in production or in use by providing the collar portions at the ends of the core material.

According to the present invention, the small diameter core material can be formed by forming the thin resilient coat over the core material.

In addition, according to the present invention, the production process can be facilitated by cutting the core material which is formed long to a suitable dimension after the core material has been covered by the thin resilient film.

Furthermore, according to the present invention, the number of production processes can be reduced further than the case where the heat shrinkable tube is used or the case where the tube is used which is swollen by petroleum oil or an organic solvent, and the production cost can also be reduced by automating the painting and coating processes.

According to the present invention, the construction of the mold can be made simple when compared to the two-color injection molding, and therefore the mold cost can be reduced.

In addition, according to the present invention, since a metallic shaft can be used for the shaft, the core material can be made thin.

Furthermore, according to the present invention, the thin resilient film can be formed with higher accuracy than the compression molding. Moreover, according to the same aspect of the invention, the production cost can be reduced by automating the molding process.

According to the present invention, since no resilient film is coated on the shaft, the external configuration of the roller can be produced small.

In addition, according to the present invention, since no resilient film is provided on the shaft, there can be produced the small diameter roller for the transfer head which has an advantage that the adhesion of the transfer film to the surface of a paper can be facilitated through the construction of the film transfer tool in which when using the film transfer tool, the pressing force of the transfer head generated when the transfer head is pressed against the surface of the paper concentrates on a single point.

Furthermore, according to the present invention, high strength can be secured by using hard resin or metal for the core material.

According to the present invention, the small diameter roller can easily be produced by forming the shaft and resilient portion continuously long and then cutting the shaft and resilient portion so formed to a required length. Thus, this aspect of the invention is effective in reducing the production cost.

In addition, according to the present invention, high strength can be secured by using a metal shaft for the shaft.

According to the present invention, since no resilient film is coated on the shaft, the external configuration of the roller can be produced small.

In addition, according to the present invention, since there is provided no resilient film, the small diameter roller for the transfer head can be produced which can facilitate the adhesion of the transfer film to the surface of a paper through the construction of the film transfer tool in which when using the film transfer tool, the pressing force of the transfer head generated when the transfer head is pressed against the surface of the paper concentrates on a single point.

Furthermore, according to the present invention, high strength can be secured by using hard resin or metal for the shaft.

What is claimed is:

1. A film transfer tool, comprising:

a case;

a feed reel disposed within said case;

a take-up reel disposed within said case;

a power transmission gear disposed within said case and interlocking said feed reel and said take-up reel;

a transfer head protruding from said case attached to said case via a section of a center portion of said transfer head;

wherein said transfer head comprises a transfer roller attached to ends of side pieces attached to ends of said center portion;

wherein said transfer roller is rotatably attached to said transfer head and comprises a metal lead and a resilient member, wherein said resilient member is attached to an outer surface of said transfer roller; and wherein said transfer roller has an outside diameter of 1 mm to 3 mm.

2. The tool of claim 1, further comprising a film transfer tape capable of winding partially around said feed reel and extending around said transfer roller, and winding partially around said take-up reel.

3. The tool of claim 1, wherein said roller includes a shaft, said shaft being elongate and having two ends, said shaft being thinner towards said ends than between said ends.

4. The tool of claim 1, wherein said roller includes a tube covering a core material.

5. The tool of claim 4, wherein the tube comprises heat shrinkable material enabling the tube to be shrunk to cover said core material.

6. The tool of claim 1, wherein a shaft piece of said transfer roller is located at an eccentric position on one of the side pieces of said transfer head.

* * * * *